United States Patent [19]

Maille

[11] 4,326,099

[45] Apr. 20, 1982

[54] LOW FREQUENCY CABINET, IN PARTICULAR FOR A TRIPHONIC AUDIO NETWORK

[75] Inventor: Michel Maille, Paris, France

[73] Assignee: Thomson-Brandt, Paris, France

[21] Appl. No.: 122,869

[22] Filed: Feb. 20, 1980

[30] Foreign Application Priority Data

Feb. 23, 1979 [FR] France ..... 79 04661

[51] Int. Cl.[3] ..... H04S 1/00

[52] U.S. Cl. ..... 179/1 GA; 179/1 G

[58] Field of Search ..... 179/1 GA, 1 G, 1 GQ, 179/1 E, 100.4 ST; 181/145, 155; 84/DIG. 27; 369/86

[56] References Cited

U.S. PATENT DOCUMENTS

| | | | |
|---|---|---|---|
| 3,016,424 | 1/1962 | Franke | 179/1 G |
| 3,076,520 | 2/1963 | Farwell | 181/145 |
| 3,400,217 | 9/1968 | Kraut | 179/1 E |
| 3,609,240 | 9/1971 | Fixler | 179/1 G |
| 3,892,917 | 7/1975 | Sotome | 179/1 GA |
| 4,200,170 | 4/1980 | Williams | 181/155 |

FOREIGN PATENT DOCUMENTS

| | | | |
|---|---|---|---|
| 2340012 | 1/1976 | France | 179/1 GA |
| 55-52694 | 4/1980 | Japan | 179/1 GA |

OTHER PUBLICATIONS

"The Case for a Third Channel" by Feldman, Radio and TV News, Mar. 1959, pp. 70, 71, 104 and 105.

*Primary Examiner*—Douglas W. Olms

[57] ABSTRACT

The present invention covers a low frequency acoustic cabinet.

The cabinet contains two enclosures holding at least one low frequency loud-speaker so that the front face of each loud-speaker radiates inside a cavity communicating with the outside through an opening of prearranged dimensions. In a preferred way of producing the invention, these enclosures are face to face so that the loud-speaker in one is opposite the loud-speaker in the other.

Such a low frequency cabinet is used in particular in high fidelity triphonic acoustic reproduction networks.

8 Claims, 3 Drawing Figures

LOW FREQUENCY CABINET, IN PARTICULAR FOR A TRIPHONIC AUDIO NETWORK

Figure 1:
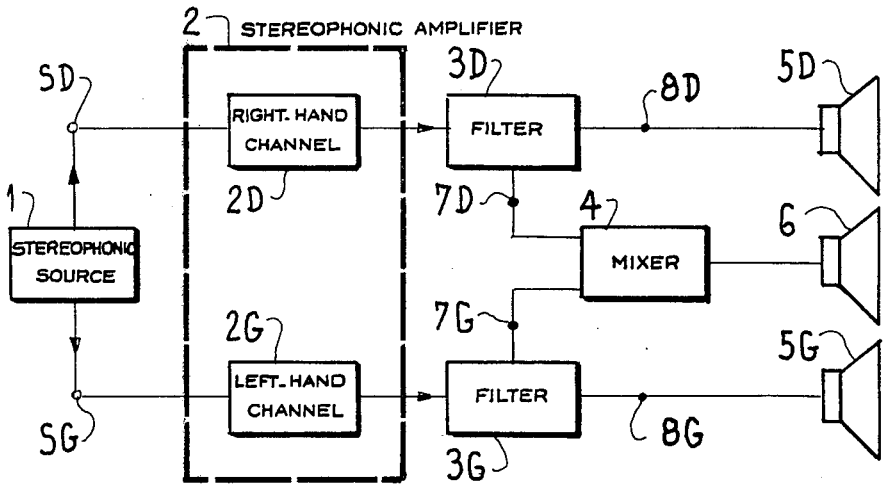

The present invention covers a low frequency cabinet used in particular in triphonic audio reproduction networks.

In classical monophonic or stereophonic networks it is very difficult to reproduce faithfully with a single loud-speaker the whole range of audio frequencies because the pass band of a loud-speaker depends on its design and dimensions. For example, for the reproduction of high-pitched sounds, the loud-speaker membrane must be light and rigid whereas, for the reproduction of low-pitched sounds on the other hand, the membrane must be as big as possible and have a flexible suspension. Hence, for good reproduction over the whole range of audio frequencies, combination loud-speaker networks in a common cabinet are generally used to form a single acoustic enclosure with a wide pass band or alternatively loud-speakers in separate cabinets forming low, medium or high frequency enclosures.

The present invention covers low frequency audio enclosures and, more especially, low frequency audio enclosures for triphonic networks.

In classical triphonic networks, just as in stereophonic networks, the sound is reproduced from two electrical signals, one coming from the right hand channel of an amplifier and the other coming from the left hand channel. However, whereas for stereophony each channel has at its output a loud-speaker or audio enclosure capable of reproducing the whole band of audio frequencies, for triphony each channel has at its output a loud-speaker or audio enclosure capable of reproducing the medium and high frequencies, i.e. the medium and high-pitched sounds, the low-pitched sounds being reproduced by a loud-speaker or audio enclosure common to both channel.

For classical triphony, the electric signal coming from the output of each of the two channels in the amplifier is injected in an electronic filter which separates the low frequency component from the rest of the signal. The two low frequency signals thus obtained are then injected in an electronic mixer to whose output the low frequency loud-speaker is connected.

The use of such electronic circuits, filters and mixer has some disadvantages from the point of view both of reliability and cost. These circuits, because of their use at the amplifier output, have to withstand currents of relatively high values.

The present invention intends to eliminate these disadvantages by producing a low frequency cabinet which can be used at the amplifier output without a filter. Also, the frequency response of the cabinet in accordance with the invention can be adapted as a function of its position in the auditorium and it is possible to adjust the low frequency level very easily.

The low frequency audio cabinet in accordance with the invention has two enclosures each with at least one loud-speaker so fitted that the rear side of each loud-speaker radiates inside its enclosure while its front face radiates inside a cavity connected to both enclosures, the internal volume of this cavity being connected to the outside by an opening of prearranged dimensions and the loud-speakers all being fed with the same electric signal.

In one way of producing the invention, the two enclosures are placed symmetrically opposite one another, the front face of the loud-speakers then radiating in the cavity formed by the extension of the partitions of the two enclosures perpendicular to the support faces of the loud-speaker(s) in such a way as to leave an opening of prearranged size.

Figure 2:
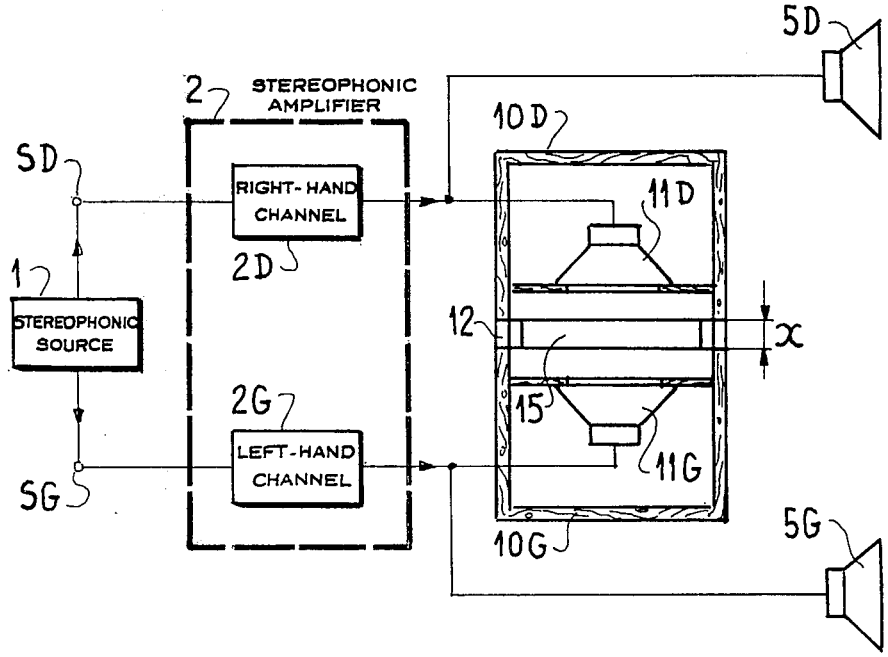
Figure 3:
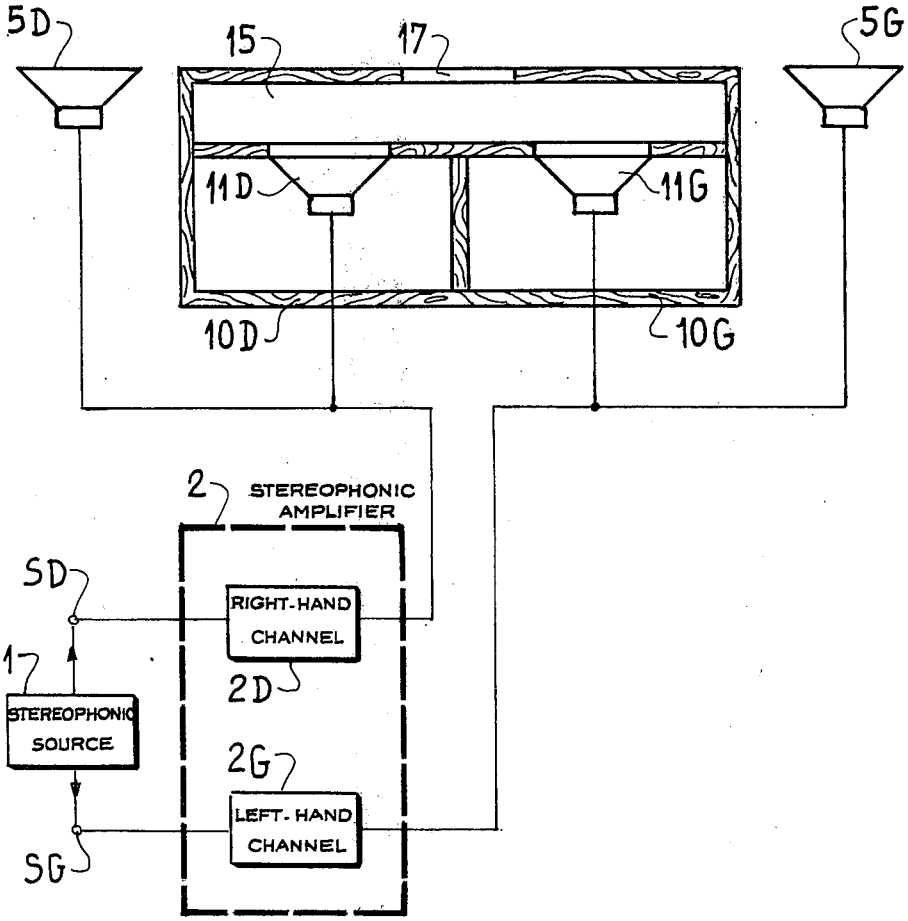

Other characteristics and advantages of the invention will appear from the following description, which is given as a non-limiting example and is illustrated by the figures attached which show in:

FIG. 1, a block diagram of a classical triphonic network,

FIG. 2, a block diagram of a triphonic network fitted with a low frequency audio cabinet in accordance with one way of producing the invention, FIG. 3, a block diagram of a triphonic network fitted with a low frequency audio cabinet in accordance with another way of producing the invention.

The triphonic network shown in FIG. 1 contains a stereophonic source 1 such as a record-player or a tape recorder. This source is connected to the inputs of a stereophonic high fidelity amplifier 2. The two channels, the left-hand one 2G and the right-hand one 2D of amplifier 2 contain various preamplifier, tone correction and power amplifier circuits. Left-hand channel 2G amplifies the signal coming from the left-hand output SG of source 1 and right-hand channel 2D the signal from the right-hand output SD.

The signal amplified by right-hand channel 2D is then injected in the input of an electronic filter 3D. The low frequency component, the frequencies lower than 200 Hz for example, of this amplified signal is available at the output 7D of this filter while the frequencies higher than 200 Hz for example are available at the output 8S.

Output 8D is connected to a loud-speaker 5D reproducing the medium and high-pitched sounds.

The signal amplified by the left-hand channel 2G is injected in the input of an electronic filter 3G, which is identical to filter 3D of the right-hand channel. The output 8G of this filter is also connected to a loud-speaker 5G reproducing the medium and high-pitched sounds.

The two low frequency outputs 7D and 7G of the two filters are connected to the inputs of a mixer 4 which, using the two low frequency signals applied to its inputs, supplies to the loud-speaker 6 connected to its output a low frequency signal identical to the signals injected in its input and of a level adapted to low frequency loud-speaker 6.

These filters, connected to the outputs of the high fidelity amplifier, i.e. to the outputs of its power amplifier stages, must withstand relatively high currents.

FIG. 2 shows a triphonic network fitted with a low frequency cabinet in accordance with one way of producing the invention.

A stereophonic source 1, which conforms to that in FIG. 1, has its outputs, the right-hand SD and left-hand SG, connected to the inputs of a high fidelity amplifier with two channels 2D and 2G.

The low frequency cabinet in accordance with the invention has two identical enclosures 10D and 10G, which are parallelepipedic for example, placed parallel one opposite the other at a prearranged distance. Each of these enclosures has on one of its faces at least one loud-speaker, 11D for enclosure 10D and 11G for enclosure 10G, so that the loud-speaker in one enclosure is opposite an identical loud-speaker in the other enclosure.

These enclosures may be of the closed type. However, such enclosures, which prevent acoustic short-circuit phenomena due to compensation of the pressure between the front and rear faces of the loud-speaker membrane for low frequencies, make it necessary to have enclosures of large size. In closed enclosures a phenomenon of resonance at frequencies related to the dimensions of the enclosure appears. The lower is the resonant frequency to be, the bigger must be the enclosure dimensions.

In another way of producing the invention, enclosures of the bass reflex type are used. In this case, an opening is arranged in the enclosure. This then acts as a Helmholtz resonator. The dimensions of this enclosure are calculated so that the low energy low frequency sounds are amplified and emitted outwards by the opening. This opening then acts as a second loud-speaker which only operates for very low frequencies.

The two enclosures are fixed symmetrically, i.e. the loud-speaker in one opposite the loud-speaker in the other and the opening in one opposite the opening in the other.

The two closed or counter-resonant enclosures have their walls extended perpendicularly to the faces on which the loud-speakers are fixed so as to form a cavity 15. Cavity 15 has an opening of width x, which represents the distance between the end of the extension of the wall of enclosure 10D and the end of the extension of the wall of enclosure 10G.

Low frequency loud-speaker 11D in enclosure 10D is connected to the output of right-hand channel 2D in amplifier 2 and loud-speaker 11G in enclosure 10G to the output of left-hand channel 2G.

These two loud-speakers receive the amplified signals coming from source 1. These two signals are different for the high frequencies and identical for the low frequencies. As a rule, sound recordings, such as discs, are made stereophonically for high and medium frequencies, i.e. those higher than about 200 Hz and monophonically for lower frequencies as the human ear is no longer able to pin-point distinctly the source of very low-pitched sounds.

Also, the low frequency loud-speakers have a very limited pass band because of the high inertia of their membrane and only radiate audibly for relatively low frequencies, less than 200 Hz for example.

The two loud-speakers opposite one another, which are fed with identical signals at the low frequencies, vibrate in phase and the assembly then operates in a way called a "pulsed air fashion". The sounds emitted outwards by the opening of width x.

The rest of the sound spectrum is reproduced by two medium-high-pitch loud-speakers, one 5D being connected to the right-hand output of the amplifier and the other 5G to the left-hand output.

Also by changing the volume of each of the enclosures 10D and 10G, it is possible to modify the low frequency resonance of the loud-speaker in its closed or bass reflex enclosure.

By modifying the volume of cavity 15, it is possible to change the high frequency cut-off of the low frequency cabinet. When this volume is increased, the cut-off frequency increases and when the volume is reduced, the cut-off frequency decreases.

The sound output of the acoustic cabinet in accordance with the invention is related to the dimensions of the opening through which the sound is emitted, i.e. the surface of width x by which the volume of cavity 15 communicates with the outside of the cabinet. Any modification of the distance between the two enclosures, i.e. any modification of the width x, causes a modification of the emissive surface and hence a modification of the sound output of the assembly.

Hence it is possible to adapt the cabinet sound output as a function of its position in the auditorium by changing the value of width x. To do this, the two enclosures can be held at a variable distance by means of a system of wedges fitted between the two enclosures or by adjustable jacks or any other means able to perform this function.

When the cabinet is in position, in the corner of a room for example, of its four emitting faces of width x, if the enclosures are parallelepipedic, only two are effective since the other two are closed by the walls of the room. By increasing the width x, the emitting surface can be increased and this disadvantage corrected.

FIG. 3 shows a block diagram of a triphonic network containing a low frequency cabinet in accordance with the second way of producing the invention.

The two enclosures 10D and 10G are placed side by side and have a common wall. The loud-speaker(s) 11D of enclosure 10D is/are placed in the same plane as the loud-speaker(s) 11G of enclosure 10G.

The front faces of these loud-speakers radiate in a cavity 15 formed by the extension of the walls which are not common of enclosures 10D and 10G and by a wall covering the whole which is parallel to the loud-speaker support faces.

The volume of this cavity 15 communicates with the outside by an opening 17 whose dimensions determine the cabinet sound output.

Just as in the case of FIG. 2, by changing the volume of enclosures 10D and 10G, it is possible to modify the low frequency resonance of the loud-speaker in its enclosure which can be closed or bass reflex and by modifying the volume of cavity 15 it is possible to change the low frequency cut-off of the low frequency cabinet.

Loud-speaker 11D of enclosure 10D and a medium-high-pitch loud-speaker 5D are connected to the output of channel 2D in amplifier 2 and loud-speaker 11G of enclosure 10G and a medium-high-pitch loud-speaker 5G are connected to the output of channel 2G.

As in FIG. 2, loud-speakers 11D and 11G vibrate in phase and the sounds emitted by each of them are mixed in cavity 15 and emitted to the outside through the opening 17.

These low frequency cabinets in accordance with the invention are mainly used in triphonic high fidelity sets but they may also be used without problems for the reproduction of low-pitch sounds in a monophonic set or a stereophonic set, a cabinet in accordance with the invention being connected to each of the two channels.

What is claimed is:

1. A low frequency acoustic cabinet, especially for frequencies of less than 200 Hz, comprising:

first and second loud-speakers, each having a front and rear face, first and second enclosures, the rear face of the first and second loud-speakers radiating respectively in the first and second enclosures, and a single tuned cavity in which radiate the front faces of the two loud-speakers and which is connected to the outside by an opening of predetermined dimensions, said cavity forming a low pass filter, the high frequency limit of which depends on its volume and the amplitude of the sound signal being dependent of the surface of said opening, said first and second loud-speakers being adapted to receive the output signal from respectively right-hand and left-hand channels of a stereophonic amplifier.

2. The low frequency acoustic cabinet of claim 1, wherein the first and second enclosures comprise two parallel walls to which are fixed respectively the first and second loud-speakers, and which form also walls of said cavity, the other walls of said cavity being formed by respective extensions of other walls of the enclosures which are separated by a predetermined distance in order to form said opening of the tuned cavity.

3. The low frequency acoustic cabinet of claim 2, comprising a set of interchangeable wedges of variable thickness so as to vary said distance.

4. The low frequency acoustic cabinet of claim 2, wherein the distance between the extensions is variable by means of adjustable jacks.

5. The low frequency acoustic cabinet of claim 1, wherein the two enclosures are placed side by side so as to have walls in the same plane to which are fixed the respective loud-speakers and which form a wall of the tuned cavity, the other walls of this cavity being formed by extensions of walls of the first and second enclosures and by another wall parallel to said wall supporting the loud-speakers and which presents the opening of predetermined dimensions.

6. The low frequency acoustic cabinet of claim 1, wherein said enclosures are identical.

7. The low frequency acoustic cabinet of claim 1, wherein the two enclosures are of the bass-reflex type.

8. A triphonic acoustic reproduction network comprising:

a stereophonic source, a two channel high fidelity amplifier with a left-hand channel and a right-hand channel connected to the stereophonic source, and a low frequency acoustic cabinet for frequencies of less than 200 Hz comprising:

first and second loud-speakers, each having a front and rear face, first and second enclosures, in which radiate the rear face of the first and second loud-speakers, respectively, and, a single tuned cavity in which radiate the front faces of the two loud-speakers and which is connected to the outside by an opening of predetermined dimensions, said cavity forming a low pass filter, the high frequency limit of which depends on its volume, and the amplitude of the sound signal being dependent on the surface of said opening, said first and second loud-speakers being adapted to receive the output signal from respectively the right-hand and left-hand channel of the stereophonic amplifier.

* * * * *